US007080584B2

(12) United States Patent
Boscolo

(10) Patent No.: US 7,080,584 B2
(45) Date of Patent: Jul. 25, 2006

(54) METHOD AND APPARATUS FOR PERFORATING A NON-WOVEN SHEET

(75) Inventor: Galliano Boscolo, Vigliano Biellese (FR)

(73) Assignee: ALBIS, Milan (IT)

( * ) Notice: Subject to any disclaimer, the term of this patent is extended or adjusted under 35 U.S.C. 154(b) by 0 days.

(21) Appl. No.: 09/902,529

(22) Filed: Jul. 10, 2001

(65) Prior Publication Data

US 2002/0088321 A1 Jul. 11, 2002

(30) Foreign Application Priority Data

Jul. 12, 2000 (FR) ..... 00 09106
Jul. 12, 2000 (FR) ..... 00 09114

(51) Int. Cl.
*B26D 1/62* (2006.01)
*B26F 1/08* (2006.01)
*D04H 13/00* (2006.01)

(52) U.S. Cl. ..... 83/37; 83/337; 83/345; 83/348; 83/669; 83/678; 83/685

(58) Field of Classification Search ..... 234/49, 234/50; 83/30, 37, 38, 331, 337, 338, 343, 83/345, 348, 646, 669, 670, 678, 685, 690, 83/691, 695; 408/19, 35
See application file for complete search history.

(56) References Cited

U.S. PATENT DOCUMENTS 1,649,635 A 11/1927 Willard ..... 83/345
2,792,062 A * 5/1957 Pierce ..... 83/337
2,956,740 A * 10/1960 McGregor ..... 234/49
3,081,030 A * 3/1963 McGregor ..... 234/50
3,106,859 A * 10/1963 Huffman ..... 83/345
3,120,922 A * 2/1964 Waldrum ..... 234/50
3,463,042 A 8/1969 Goldman ..... 83/627
3,657,954 A * 4/1972 Wilkins ..... 83/345
4,594,926 A * 6/1986 Propheter ..... 83/345
4,597,144 A * 7/1986 Frank et al. ..... 483/37
4,674,372 A * 6/1987 Mobley ..... 83/30
4,688,459 A * 8/1987 Osborn et al. ..... 83/698.31
5,103,706 A * 4/1992 Rosemann ..... 83/670
5,136,905 A * 8/1992 Stack et al. ..... 83/23
5,152,209 A * 10/1992 Berger ..... 83/670
5,429,573 A * 7/1995 Jahnke et al. ..... 483/1

(Continued)

FOREIGN PATENT DOCUMENTS

CH 479 383 10/1969

(Continued)

*Primary Examiner*—Clark F. Dexter
(74) *Attorney, Agent, or Firm*—Weingarten, Schurgin, Gagnebin & Lebovici LLP

(57) ABSTRACT

To produce at least one perforation in a non-woven sheet (N) of fibers or filaments, the sheet (N) is brought into contact with a perforated cylinder (2), equipped with at least one insert (8). Each insert includes, at one end, a plane surface (S), and is provided with a recess (8*b*) which emerges in the plane surface (S), and which has a sharp edge (8*g*) formed by the intersection of the inner surface (8*f*) of the recess (8*b*) with the plane surface (S). A perforation in the non-woven sheet (N) is obtained by cutting out a portion (P) of the non-woven sheet (N) by shearing of the fibers or filaments of the non-woven sheet (N), between the sharp edge (8*g*) of the insert (8) and a perforating member (9) driven simultaneously in translation and in rotation about its own axis.

12 Claims, 3 Drawing Sheets

U.S. PATENT DOCUMENTS 5,937,719 A * 8/1999 Davis et al. ..... 83/345
6,298,531 B1 * 10/2001 Baumbusch et al. ..... 29/40

FOREIGN PATENT DOCUMENTS

DE 25 38 900 3/1977
DE 30 37 255 * 4/1982
DE 31 40 511 * 4/1983
DE 44 17 110 * 11/1995
EP 0 974 433 A1 1/2000
FR 1 491 848 7/1967
JP 6-79697 3/1994
JP 11-33996 2/1999

* cited by examiner

METHOD AND APPARATUS FOR PERFORATING A NON-WOVEN SHEET

BACKGROUND OF THE INVENTION

The present invention relates to the field of non-woven sheets, made of fibers or filaments, and intended, in particular, but not exclusively, for use in making sanitary articles, for example for disposable diapers for babies, for incontinent adults or for female sanitary protection. It relates, more especially, to a method for perforating a non-woven sheet and to an apparatus suitable for implementing this method.

There exist various methods for perforating non-woven sheets.

Document EP-A-0214608 describes a method for perforating a non-woven fabric which comprises, specifically, thermoplastic fibers or filaments. This method consists in perforating the non-woven sheet by means of a plurality of needles which cooperate with a plurality of recesses. Through the action of the needles, the fibers of the non-woven sheet are pushed back locally and, in order to preserve the void thus formed, the studs and the contour of the recesses are heated so as to cause the thermoplastic fibers to melt. After the melted fibers have hardened, a perforation is obtained that has the shape of the needle and the contours of which are delimited and consolidated by fibers that have melted and are thus welded together.

This method has the drawback, on one hand, of necessitating the use of a non-woven fabric containing thermoplastic fibers and, on the other hand, of imparting a certain amount of rigidity to the non-woven fabric owing to the presence of the hardened areas on the periphery of the perforations.

Document EP-A-0974433 describes another type of method for perforating a non-woven sheet. According to this method, the sheet is pushed by a perforating member inside a through orifice provided in a thin part in such a way that the non-woven sheet projects from said hole. Cutting means positioned inside the thin part then cut the fibers projecting from said part so as to form perforations. The perforating member is a cylindrical stud the end of which is hemispherical, and which is designed to be driven simultaneously in translation along its longitudinal axis and in rotation about its own axis. The function of this perforating member is not to cut the fibers or the filaments of the sheet, this function being performed by the cutting members. This method necessitates a relatively complex device comprising, in particular, a hollow cylinder, the interior of which is equipped with cutting members and necessitates the use of a thin part in which the orifices are provided. In addition, this method does not guarantee that perforations having a sharp contour that is reproducible in time will be obtained.

BRIEF SUMMARY OF THE INVENTION

The object of the present invention is to provided a novel method for perforating a non-woven sheet of fibers or of filaments that remedies, in particular, wholly or in part, the drawbacks associated with the use of the methods of the prior art.

The method according to the invention is known, in particular, from patent application EP-A-0974433, in that the non-woven sheet is brought into contact with a perforated cylinder, and at least one perforation is made in the sheet by means of at least one perforating member, which is driven simultaneously in translation and in rotation about its own axis.

In a manner characteristic of the invention, there is previously fixed on the perforated cylinder at least one insert, including at one end a plane surface, and provided with a recess that emerges in said plane surface, and which has a sharp edge formed by the intersection of the inner surface of said recess with said plane surface; a perforation in the non-woven sheet is obtained by cutting out a portion of the non-woven sheet by shearing the fibers or filaments of the non-woven sheet, between the sharp edge of said insert and a perforating member driven simultaneously in translation and in rotation about its axis.

The Applicant has demonstrated that the fact of implementing a sharp edge formed in a plane (plane end surface of the insert), in combination with a perforating member driven in rotation about its own axis, advantageously enables the fibers or filaments of the non-woven sheet to be cut by shearing over the entire perimeter of the sharp edge, and thus enables perforations with sharp contours to be obtained. By way of comparison, in a device such as the one described in aforementioned European patent application EP-A-0974433, owing to the curvature of the outer face of the perforated cylinder (the face with which the sheet is brought into contact), the orifices of this cylinder in said outer surface are not perfectly plane. As a result, in practice, it is not possible, using the perforating members (studs) of this apparatus, to shear the fibers or filaments of the non-woven sheet over the entire periphery of said orifices. Thus, unlike the invention, in this prior art apparatus, a cutting member (reference number 16 in FIG. 1 of document EP-A-0974433) has to be provided inside the cylinder, which member makes it possible to cut the portions of sheet that are pushed back inside the perforated cylinder by the perforating members (studs).

The present invention also relates to an apparatus for perforating a non-woven sheet that enables the aforementioned perforating method of the invention to be implemented.

The present invention will be more readily understood, and its characteristics and advantages will emerge more clearly, on reading the description that follows and that refers to the annexed drawings showing a preferred form of embodiment of the apparatus of the present invention, presented by way of a non-limitative example, and wherein:

DETAILED DESCRIPTION OF THE INVENTION

Figure 1:
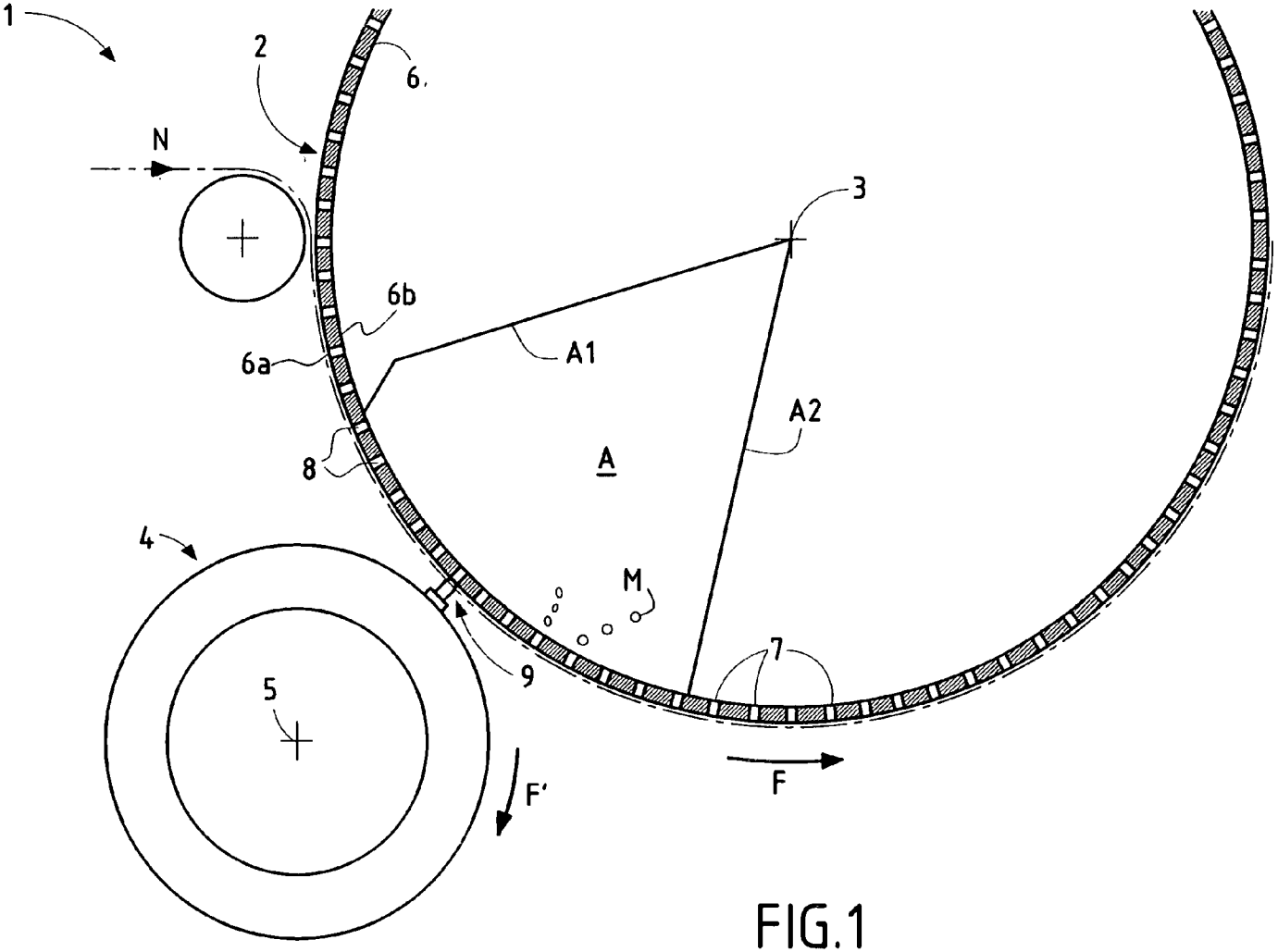
FIG. 1 is a partial diagrammatic cross-sectional view of the preferred form of embodiment of the present invention.

The preferred form of embodiment of the apparatus according to the present invention will now be described with reference to FIG. 1.

Apparatus 1, designed for perforating a non-woven sheet, comprises a first cylinder 2 which is a perforated cylinder. This cylinder 2 is driven in rotation (arrow F) about its longitudinal axis 3. Apparatus 1 also comprises a second cylinder 4 driven in rotation (arrow F') about its longitudinal axis 5 parallel to axis 3 of first cylinder 2.

First, perforated cylinder 2 comprises on its external periphery a cylindrical piece 6 provided with a plurality of through perforations 7. These perforations 7 are aligned with the axis of the cylinder in the form of parallel rows distributed over the entire periphery of the cylinder. Each perforation 7 is equipped with a removable insert 8, which will be described in greater detail with reference to FIG. 2. In another alternative embodiment (not shown), insert 8 could be dispensed with and directly replaced by the perforated wall of cylinder 2.

Second cylinder 4 is equipped on its periphery with studs 9, which are arranged to cooperate with inserts 8 of perforations 7 provided in external piece 6 of first cylinder 2. In the preferred form of embodiment shown here, cylinder 2 also comprises a fixed suction area A which is delimited by walls A1 and A2, and which enables sheet N to be pressed by suction against first face 6*a* of piece 6 and enables the pieces M of the sheet that have been cut out to be discharged.

Figure 2:
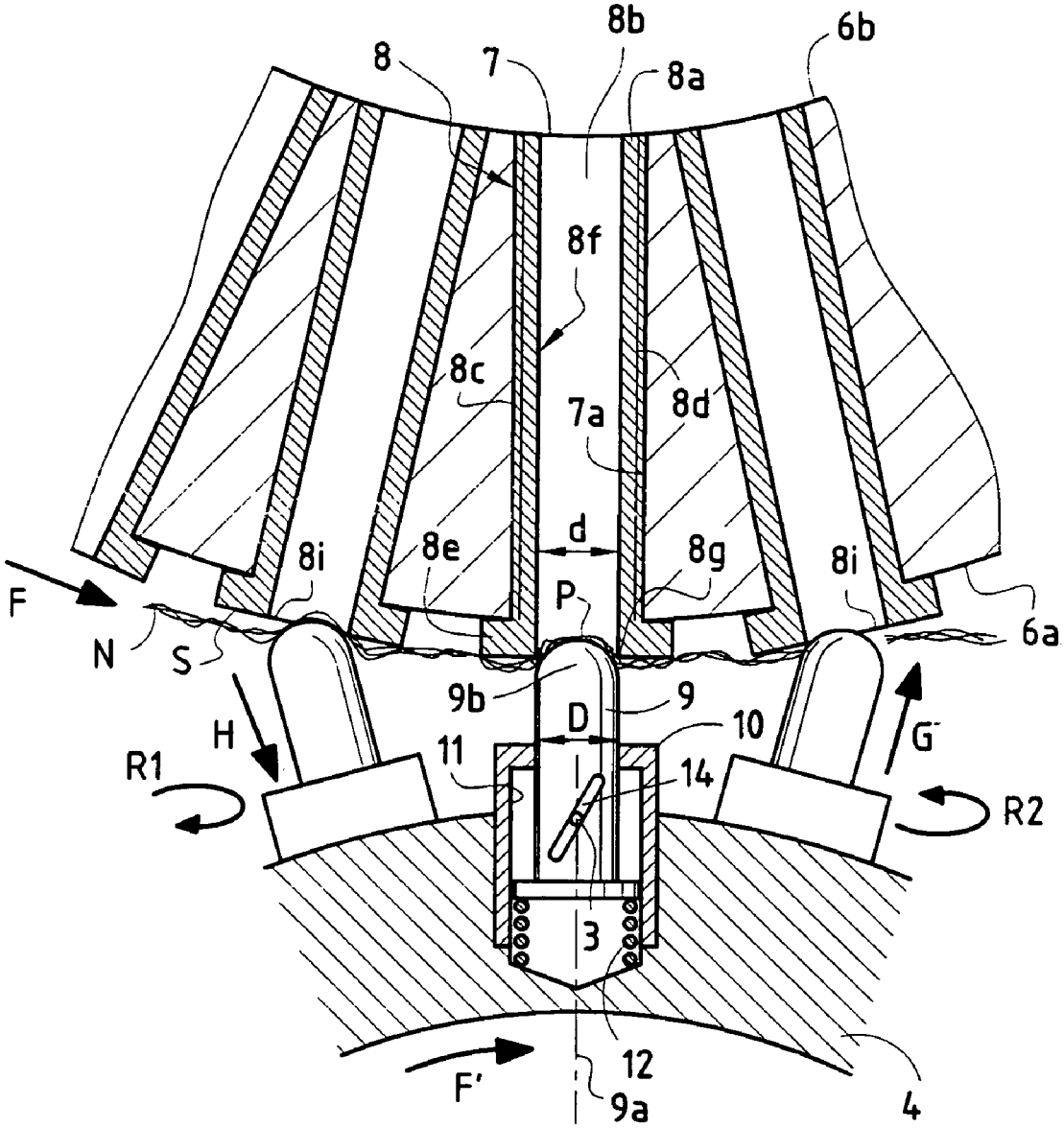
FIG. 2 is an enlarged partial view of the apparatus of FIG. 1, in the area in which a stud cooperates with an orifice in the first cylinder with a view to perforating the non-woven sheet.

With reference to FIG. 2, each insert 8 includes a body 8*a* provided with a recess (or perforation) 8*b* having a circular cross-section. This recess 8*b* is a through orifice in the example shown, but it could also, according to the invention, have a bottom, at the opposite end from its external orifice 8*i*. Outer surface 8*c* of body 8*a* is equipped with a thread 8*d* which engages with a reverse thread 7*a* provided inside each perforation 7 in order to fix each insert 8 in a perforation 7. Body 8*a* comprises, at one of its ends, a flange 8*e* having a plane outer surface (S), in which emerges recess 8*b* (orifice 8*i*). Plane surface (S) of flange 8*e* forms, with the inner surface 8*f* of recess 8*b*, a sharp edge 8*g*. Flange 8*e* can advantageously serve as a gripping means for fixing inserts 8 in, or removing them from, perforations 7.

Figure 3:
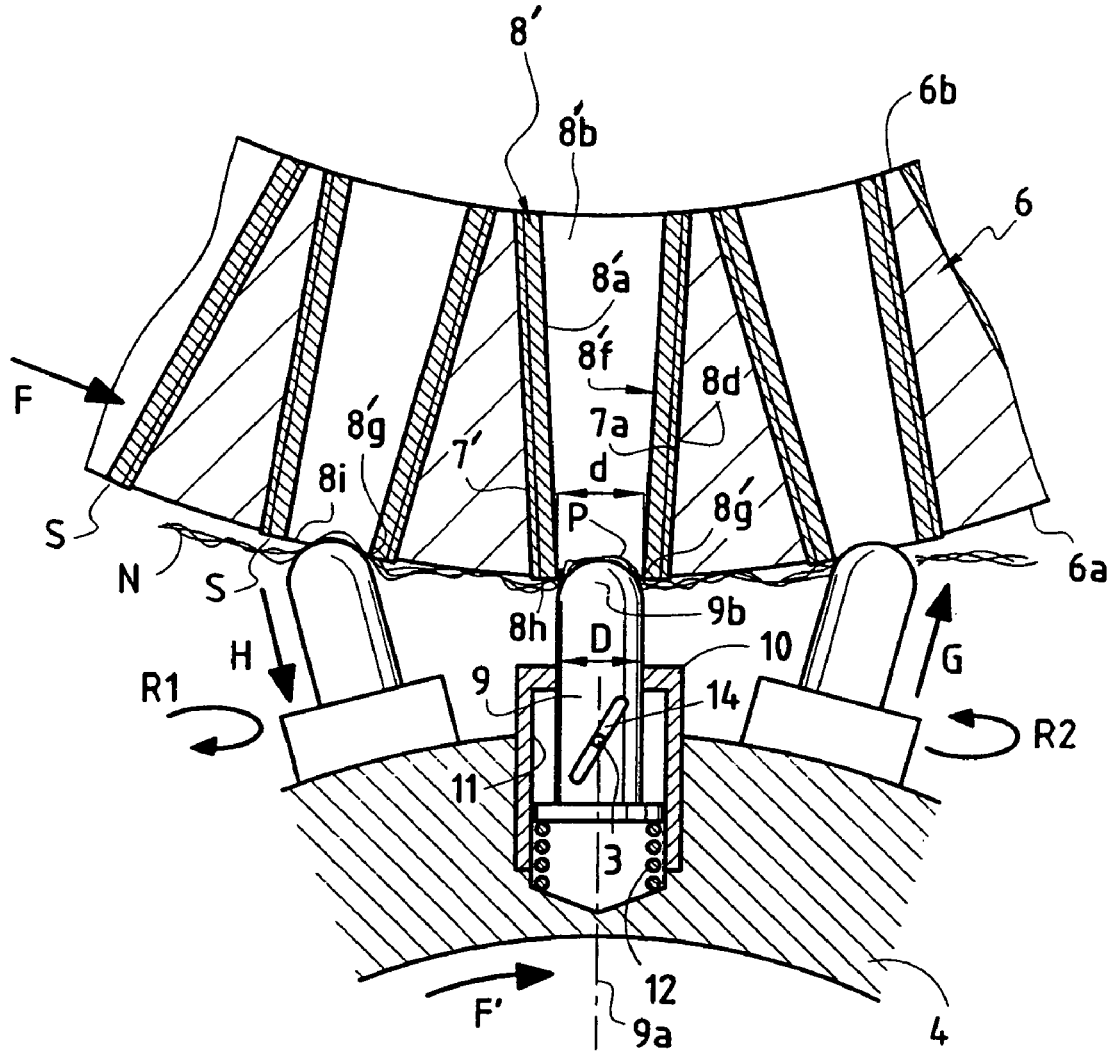
FIG. 3 shows an alternative embodiment of the device according to the invention.

In one alternative embodiment shown in FIG. 3, insert 8' does not have a flange 8*e* and recess 8*b'* emerges in the area of a plane end 8*h* of the insert. Such an insert does have a sharp edge 8*g'*, formed by the intersection of the inner surface 8*f* of recess 8*b'* with end 8*h* of the insert 8', which end 8*h* forms a plane surface (S), which corresponds to the thickness of body 8*a'*. In this variant, the diameter of perforations 7' increases from first face 6*a* of piece 6 towards second face 6*b* of the latter; the diameter of the recess of each insert 8' increases starting from sharp edge 8*g'*. The flared shape of recess 8' resulting therefrom facilitates the removal of pieces M from recesses 8*b'*. This additional characteristic can also be applied to a variant having inserts equipped with flanges, of the type shown in FIG. 2.

In one alternative embodiment of the means for cutting the non-woven sheet shown in FIG. 2, stud 9 is mounted in an external piece 10 of the second cylinder 4 via a housing 11 at the bottom of which is placed a spring 12. Stud 9 is a cylinder having an axis 9*a* which is arranged in housing 11 in such a way as to rotate about its own axis (about its axis 9*a*) when it moves in the direction of arrow H (that is to say in a direction parallel to its axis of rotation and in the opposite direction from perforated cylinder 2). More precisely, stud 9 is provided with a pin 13 projecting inside housing 11, with said pin penetrating a slideway 14 which is formed in the wall of housing 11 and which is inclined in relation to direction H of translation movement of stud 9.

When stud 9 moves in translation, pin 13 moves correlatively along slideway 14. Owing to the inclination of slideway 14, stud 9 rotates slightly about its own axis in a first direction of rotation R1 when it moves in translation in direction H, and in a second direction of rotation R2 when it moves in direction G opposite to direction H, that is to say in the direction of perforated cylinder 2. In this preferred form of embodiment, thread 8*d* equipping each of inserts 8 is such that rotational movement in direction R1 of studs 9 more tightly secures each of inserts 8 in perforations 7.

Stud 9 has a rounded end 9*b*, of a hemispherical type, and a diameter D slightly greater than diameter d of orifice 8*i* of recess 8*b* of insert 8, so as to be able to press sheet N between said hemispherical end 9*b* and sharp edge 8*g* of insert 8, which makes it possible to cut sheet N locally.

The operation of the device according to the invention will now be explained.

The two cylinders, 2 and 4, are driven in rotation (arrows F and F'/FIGS. 2 and 3), being synchronized with one another such that hemispherical end 9*b* of a stud 9 is pressed precisely on sharp edge 8*g* of insert 8 with which it cooperates to produce a perforation locally in sheet N.

Owing to the rotation of cylinders 2 and 4, in a first stage, stud 9 comes into contact with insert 8 and is pushed back in contact with this insert 8 in direction H (left-hand stud in FIGS. 2 and 3), spring 12 being compressed. During this first translation movement in direction H, the stud is simultaneously driven in rotation in direction R1. When stud 9 and insert 8 are perfectly aligned (end of first stage/central stud in FIGS. 2 and 3), compression of the spring is at its maximum, and hemispherical end 9*b* of stud 9 is pressed perfectly against sharp edge 8*g* of insert 8. Then, in a second stage, owing to the rotation of the two cylinders, insert 8 and stud 9 leave their aligned position. In this second stage, the spring exerts on stud 9 a return force that enables it to be driven in translation in direction G, opposite from direction H. During this second translation movement in direction G, the stud is simultaneously driven in rotation in direction R2 opposite from R1 (second stage/right-hand stud in FIGS. 2 and 3).

During the aforementioned two stages, the end of stud 9 slightly penetrates housing 8*b* of corresponding insert 8, locally pushing back the portion (P) of the sheet located opposite said recess 8*b*, and presses said portion (P) of the sheet against sharp edge 8*g*. As the diameter D of the hemispherical end of a stud 9 is greater than the diameter d of recess 8*b*, and as edge 8*g* is located within a plane area (plane surface S of flange 8*e* or of end 8*h* of the insert), sheet N is thus locally compressed between sharp edge 8*g* and thus cut by shearing of the fibers or filaments going to make up sheet N, through the combined actions of rotation (in the two directions of rotation R1 and R2) of stud 9 and of pressure between said stud 9 and edge 8*g*.

According to the invention, it is important for each insert 8 to have a surface (S) that is plane. The Applicant has, in fact, demonstrated, without, however, being committed to this explanation, that, when the surface of flange 8*e* that comes into contact with sheet N is not rigorously plane, but is, for example, slightly curved as is, for example, the surface of perforated cylinder 2, it is not possible to obtain sufficient contact between the end of stud 9 and the totality of the perimeter of sharp edge 8*g*, so that it is not possible to press sheet N uniformly and sufficiently against sharp edge 8*g* of insert 8 to ensure that an entire portion (P) of sheet is cut off.

The invention advantageously makes it possible to produce in the non-woven sheet perforations that have a sharp, reproducible contour, without it being necessary to heat the filaments of the sheet. In particular, the invention advantageously enables perforations having a circular contour to be produced. Now, in the case of a hydrophobic non-woven sheet, such as that frequently used to produce sanitary articles, it is important for the perforations produced in said sheet to be circular. Only circular perforations in fact allow water or any other liquid to pass through the hydrophobic nonwoven fabric without wetting the surface of the latter, which makes it possible to absorb a liquid while having a dry surface.

More especially, the removable nature of the inserts advantageously enables the problems of wear of the inserts and, in particular, of their sharp edges 8g, to be overcome economically. When an insert 8 is worn, it suffices to replace it with a new one. The invention is not, however, limited to the use of inserts that are removable.

The invention claimed is:

1. A method for perforating a non-woven sheet of fibers or filaments comprising the steps of:

fixing on a perforated cylinder at least one insert, including, at one end, a plane surface, and provided with a recess that emerges in said plane surface, that has an inner surface and that has a sharp edge formed by the intersection of the inner surface with the plane surface;

bringing the non-woven sheet into contact with the perforated cylinder and with the plane surface of the insert;

bringing a perforating member, which is sized to be capable of simultaneously abutting against substantially the entire sharp edge of the insert, to the recess of the insert to locally compress fibers or filaments of the non-woven sheet between the perforating member and the sharp edge of the insert, whereby force between the perforating member and the insert causes the perforating member to translate along a translational axis; and driving the perforating member such that it rotates about an axis of the perforating member that is parallel to the translation axis for cutting out a portion of the non-woven sheet by shearing of the fibers or filaments of the non-woven sheet compressed between the perforating member and the sharp edge of the insert through the combined actions of rotation and pressure.

2. Method according to claim 1, characterized in that, at the time of a perforating operation, said perforating member is driven simultaneously in rotation in a first direction of rotation and in translation in a first direction opposite from the perforated cylinder, and then is driven simultaneously in rotation in a second direction of rotation opposite from said first direction of rotation and in translation in the direction opposite from the first direction of translation.

3. Method according to claim 2, characterized in that each insert is fixed by screwing onto the perforated cylinder, and the direction of screwing of each insert corresponds to the first direction of rotation of a perforating member.

4. Method according to claim 2, characterized in that each insert is removable.

5. Method according to claim 1, characterized in that each insert is removable.

6. Method according to claim 5, characterized in that each insert is fixed by screwing onto the perforated cylinder.

7. Method according to claim 1, characterized in that each insert comprises a plane flange.

8. Method according to claim 1, characterized in that the recess of at least one said inserts has a diameter that increases starting from the sharp edge.

9. Method according to claim 1, wherein fixing the at least one insert comprises providing each insert such that the recess of the insert has a diameter that increases starting from the sharp edge.

10. A method perforating a sheet, comprising:

providing a plurality of dies revolving about a die rotation axis, each die having a sharp edge defining a shape;

providing a plurality of punches counter-revolving about a punch rotation axis that is generally parallel to the die rotation axis, wherein each punch has a surface that is sized to be capable of simultaneously abutting against substantially the entire sharp edge of a respective one of the dies;

bringing one side of the sheet into contact with at least some of the dies;

bringing at least one of the punches into contact with the other side of the sheet at a position that corresponds to a respective one of the dies to locally compress a portion of the sheet between the punch and the sharp edge of the die; and cutting out a portion of the sheet by driving the at least one punch such that the punch rotates about a longitudinal axis of the punch;

wherein the longitudinal axis of each punch is generally transverse to the punch rotation axis, and wherein the rotation of the at least one punch about its longitudinal axis and the compression of the sheet together cause shearing of the portion of the sheet compressed between the punch and the sharp edge of the die, thereby cutting out the portion of the sheet.

11. The method of claim 10, wherein driving the punch comprises:

translating the punch along the longitudinal axis in a direction away from the die and simultaneously rotating the punch in a first direction about the longitudinal axis; and then translating the punch along the longitudinal axis in a direction toward the die and simultaneously rotating the punch in a second direction, opposite the first direction, about the longitudinal axis.

12. The method of claim 11, further comprising:

mechanically linking the punch such that, if the punch translates along the longitudinal axis in the direction away from the die, the punch is driven to rotate in the first direction.

* * * * *

UNITED STATES PATENT AND TRADEMARK OFFICE

CERTIFICATE OF CORRECTION

PATENT NO. : 7,080,584 B2
APPLICATION NO. : 09/902529
DATED : July 25, 2006
INVENTOR(S) : Galliano Boscolo It is certified that error appears in the above-identified patent and that said Letters Patent is hereby corrected as shown below:

Column 6, claim 7, line 2, “a plane flange” should read --a flange--; and

Column 6, claim 8, line 4, “at least one said” should read --at least one of said--.

Signed and Sealed this

Eighteenth Day of December, 2007

JON W. DUDAS
*Director of the United States Patent and Trademark Office*